US006518924B1

(12) United States Patent
Desclos et al.

(10) Patent No.: US 6,518,924 B1
(45) Date of Patent: Feb. 11, 2003

(54) INTEGRATED MULTIFREQUENCY SLOT/ PATCH ANTENNA AND METHOD

(75) Inventors: Laurent Desclos, San Diego, CA (US); Sebastian Rowson, San Diego, CA (US); Gregory Poilasne, San Diego, CA (US)

(73) Assignee: Ethertronics, Inc., San Diego, CA (US)

( * ) Notice: Subject to any disclaimer, the term of this patent is extended or adjusted under 35 U.S.C. 154(b) by 0 days.

(21) Appl. No.: 09/929,383

(22) Filed: Aug. 13, 2001

(51) Int. Cl.[7] ..... H01Q 1/38
(52) U.S. Cl. ..... 343/700 MS; 343/846
(58) Field of Search ..... 343/722, 846, 343/700 MS, 713, 702, 848, 815, 817, 833, 834

(56) References Cited

U.S. PATENT DOCUMENTS 5,781,158 A * 7/1998 Ko et al. ..... 343/700 MS
6,222,497 B1 * 4/2001 Hu et al. ..... 343/846
6,281,848 B1 * 8/2001 Nagumo et al. ..... 343/700 MS

* cited by examiner

*Primary Examiner*—Don Wong
*Assistant Examiner*—James Clinger
(74) *Attorney, Agent, or Firm*—Blakely, Sokoloff, Taylor & Zafman LLP

(57) ABSTRACT

An antenna structure has the approximate characteristics of a slotted cylinder. Rather than utilizing a complete cylinder, the antenna structure utilizes a pair of spaced-apart patches that are joined together by one or more transmission lines that loop around with the same length as the perimeter of a corresponding cylinder. The antenna structure may be advantageously "wrapped" around an enclosure for an electronic device, such as a cellular telephone or the like.

34 Claims, 14 Drawing Sheets

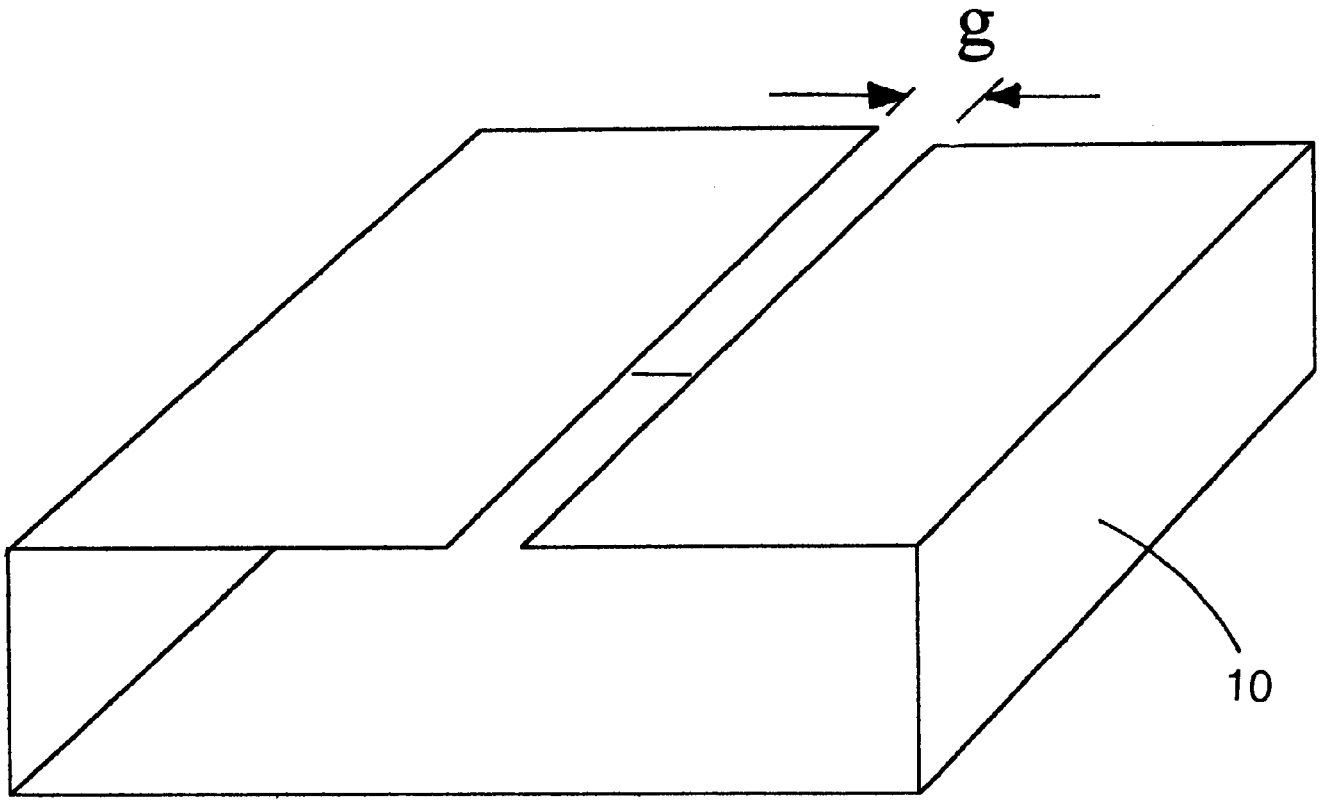
-Fig.1-

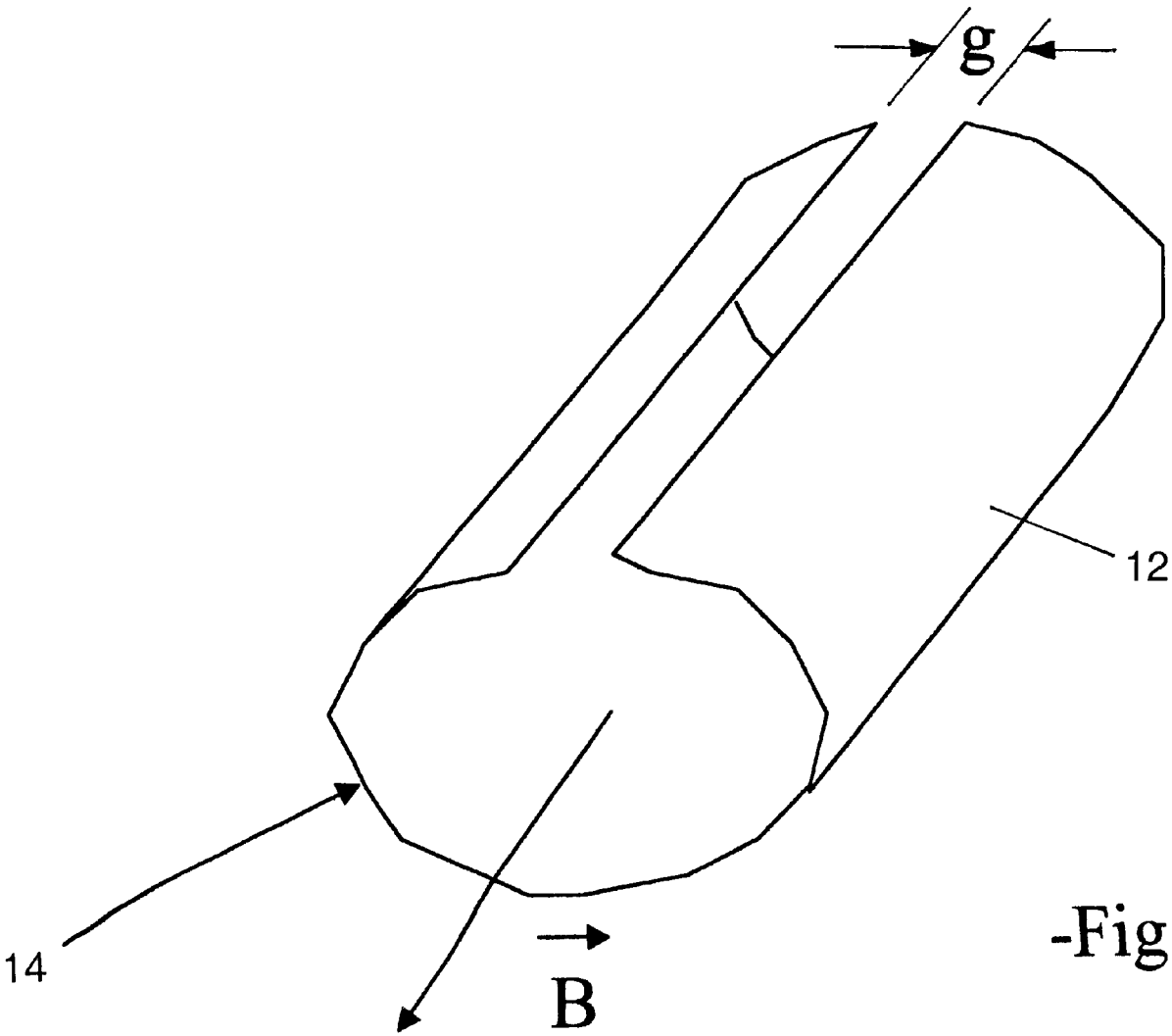
-Fig.2-

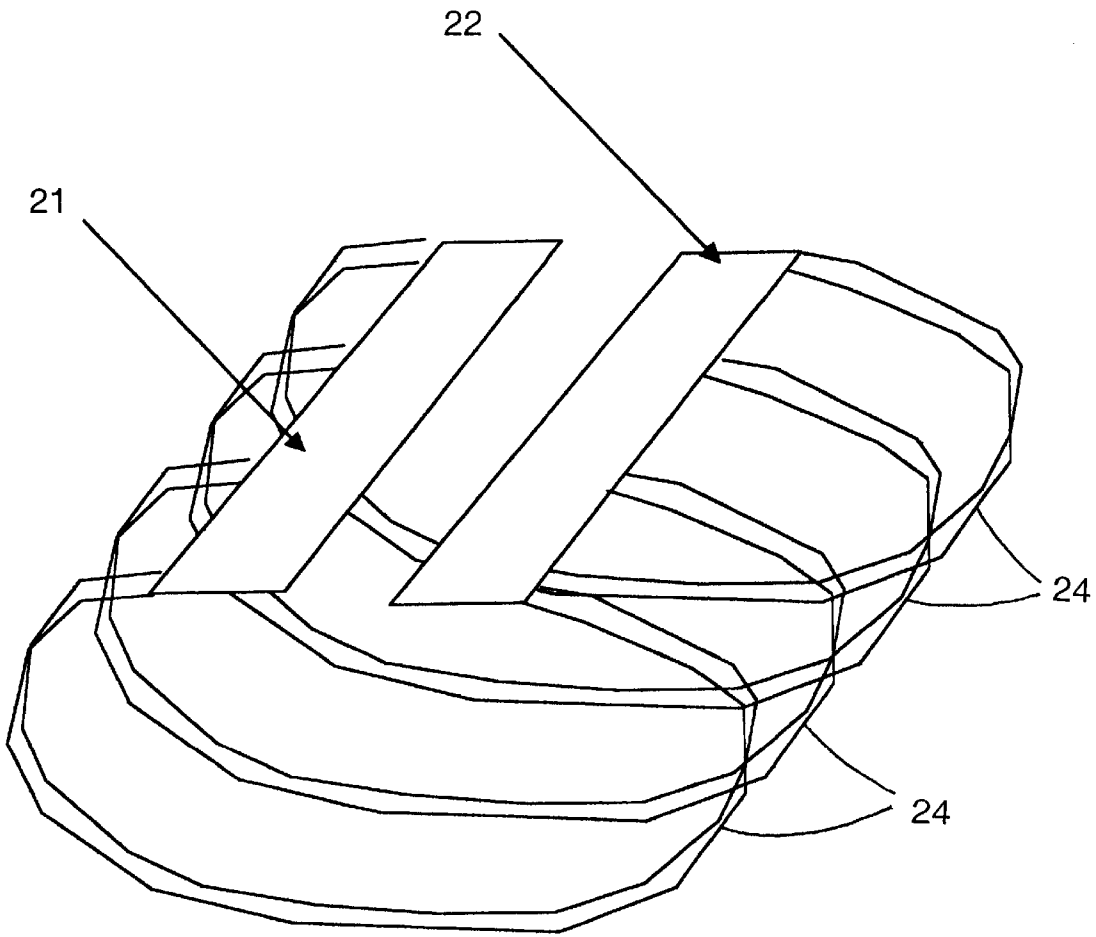
-Fig. 3-

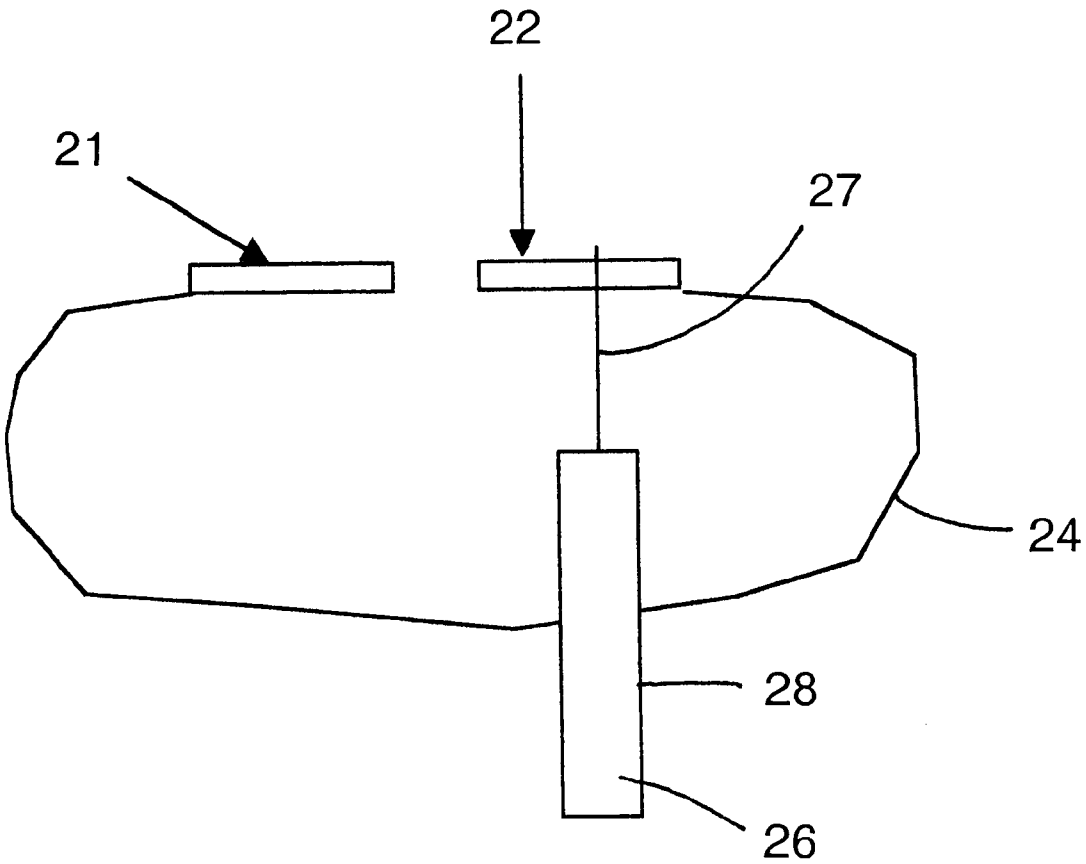
-Fig.4-

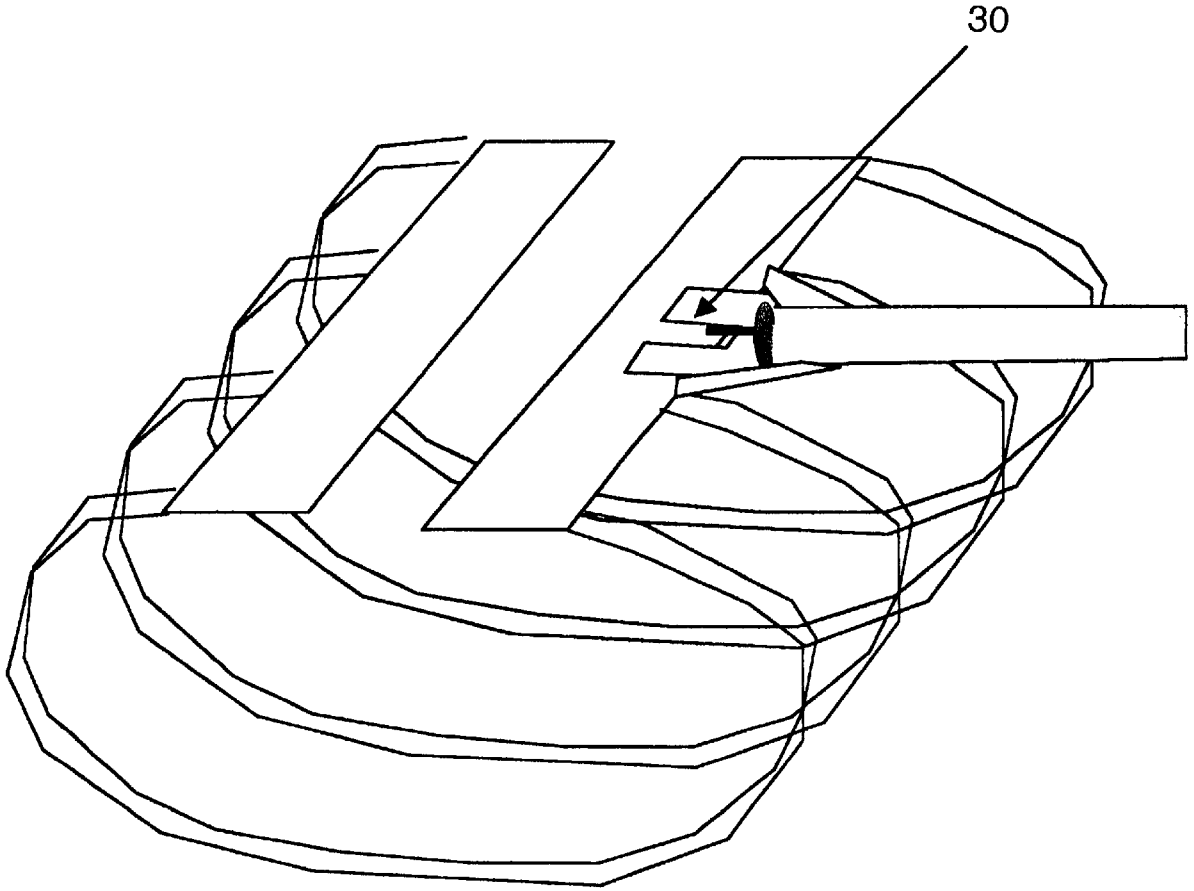
-Fig.5-

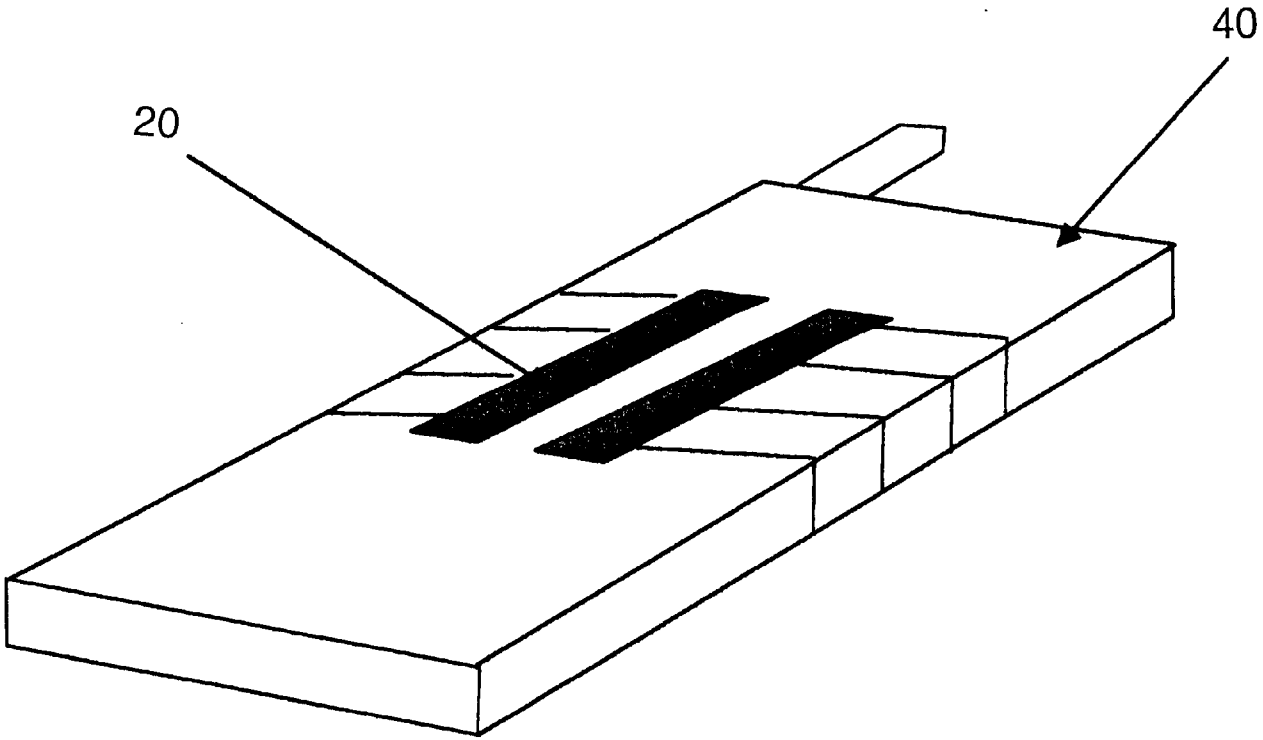
-Fig.6-

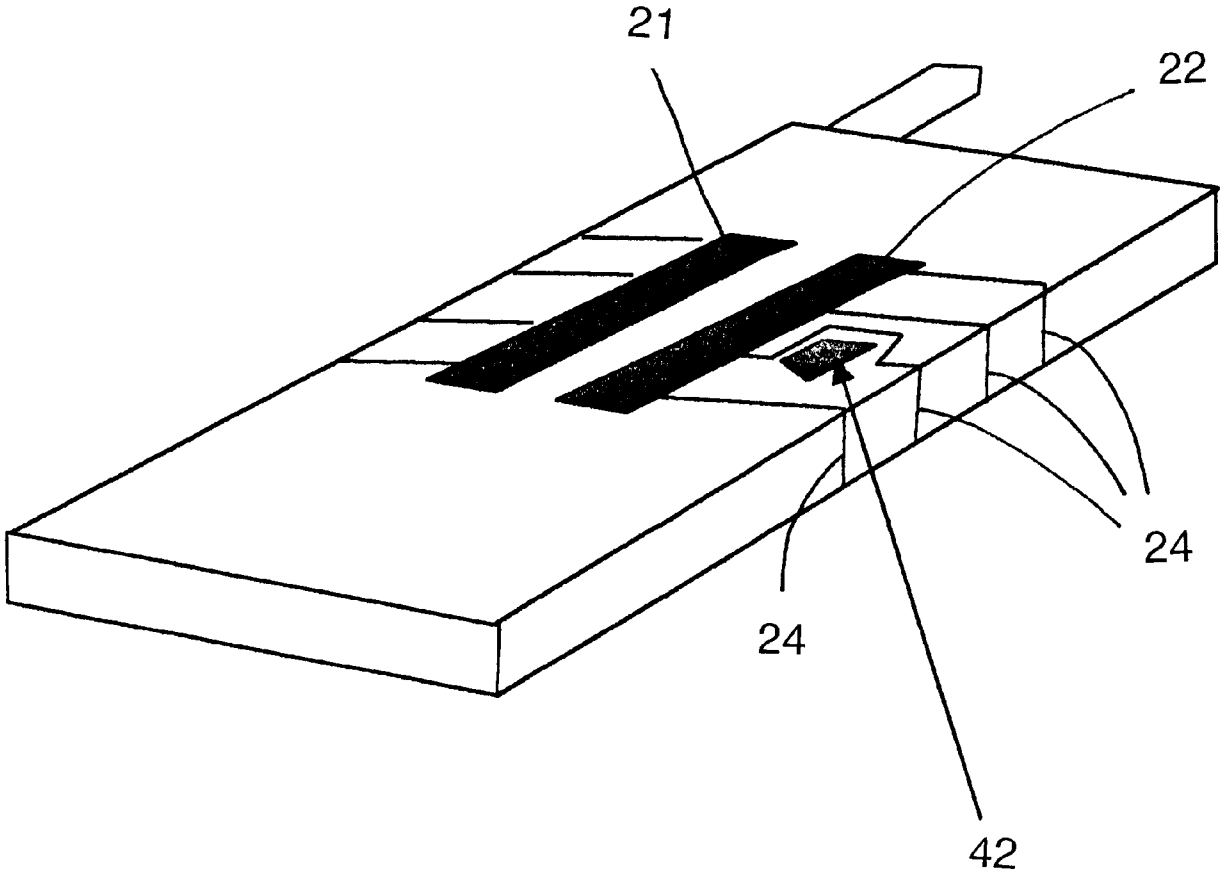
-Fig. 7-

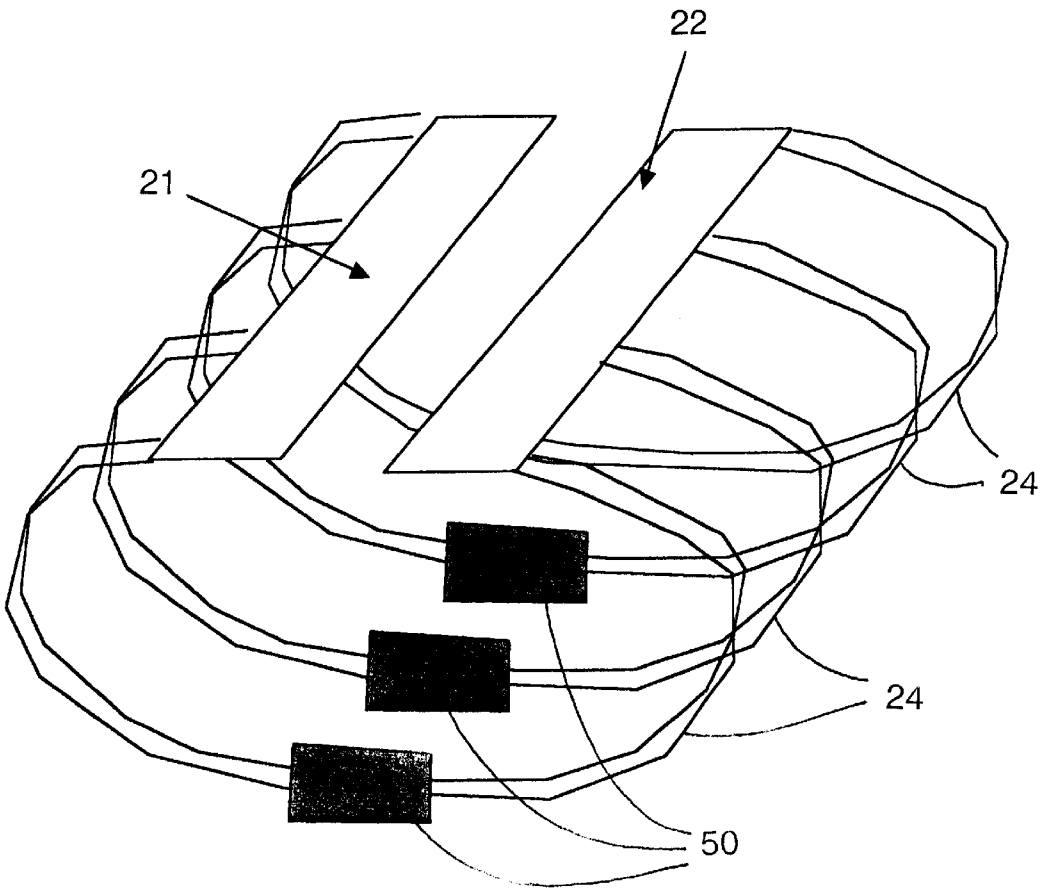
-Fig. 8-

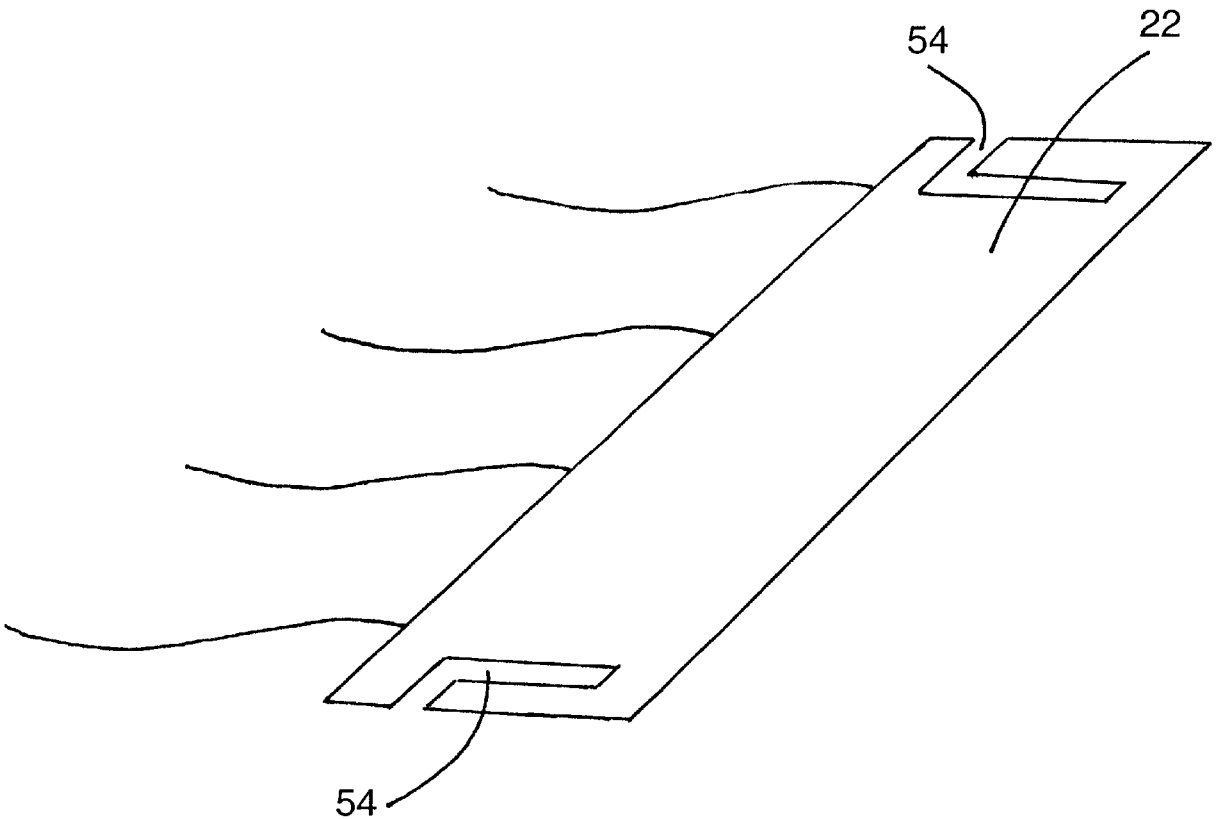
-Fig. 9-

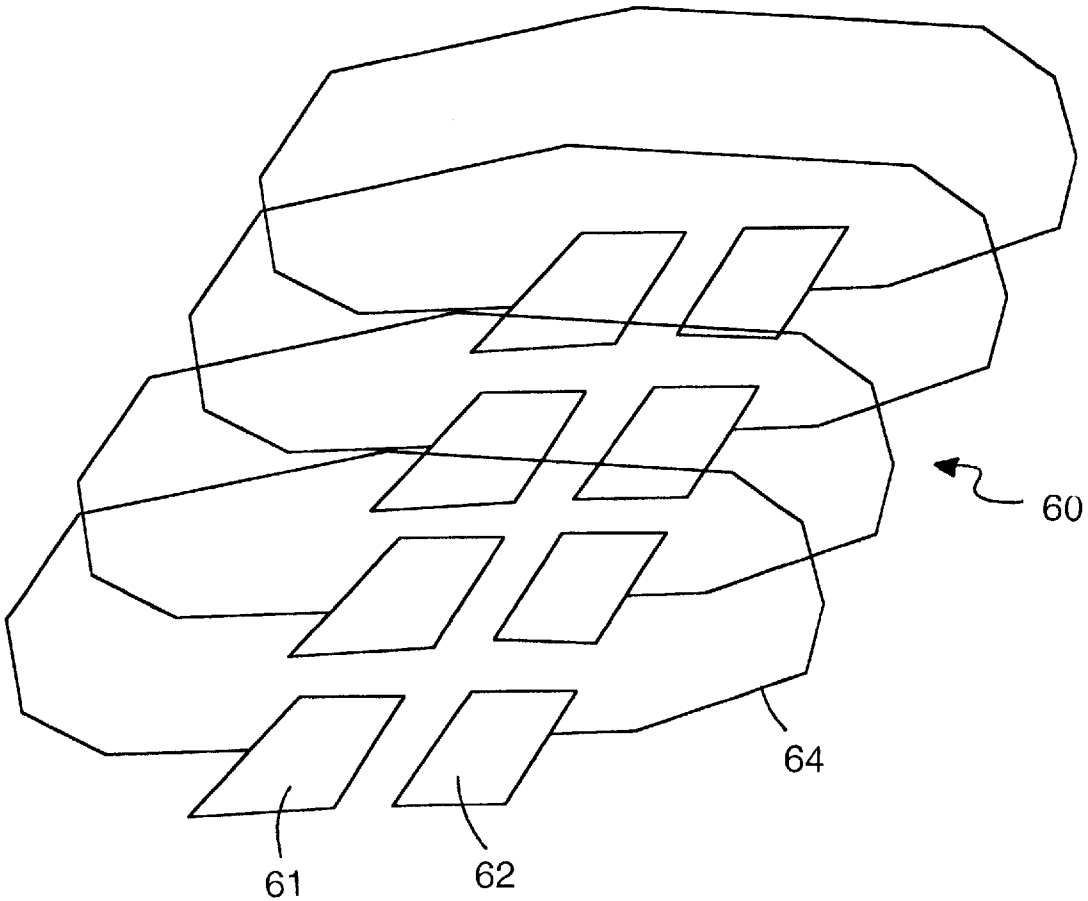
-Fig. 10-

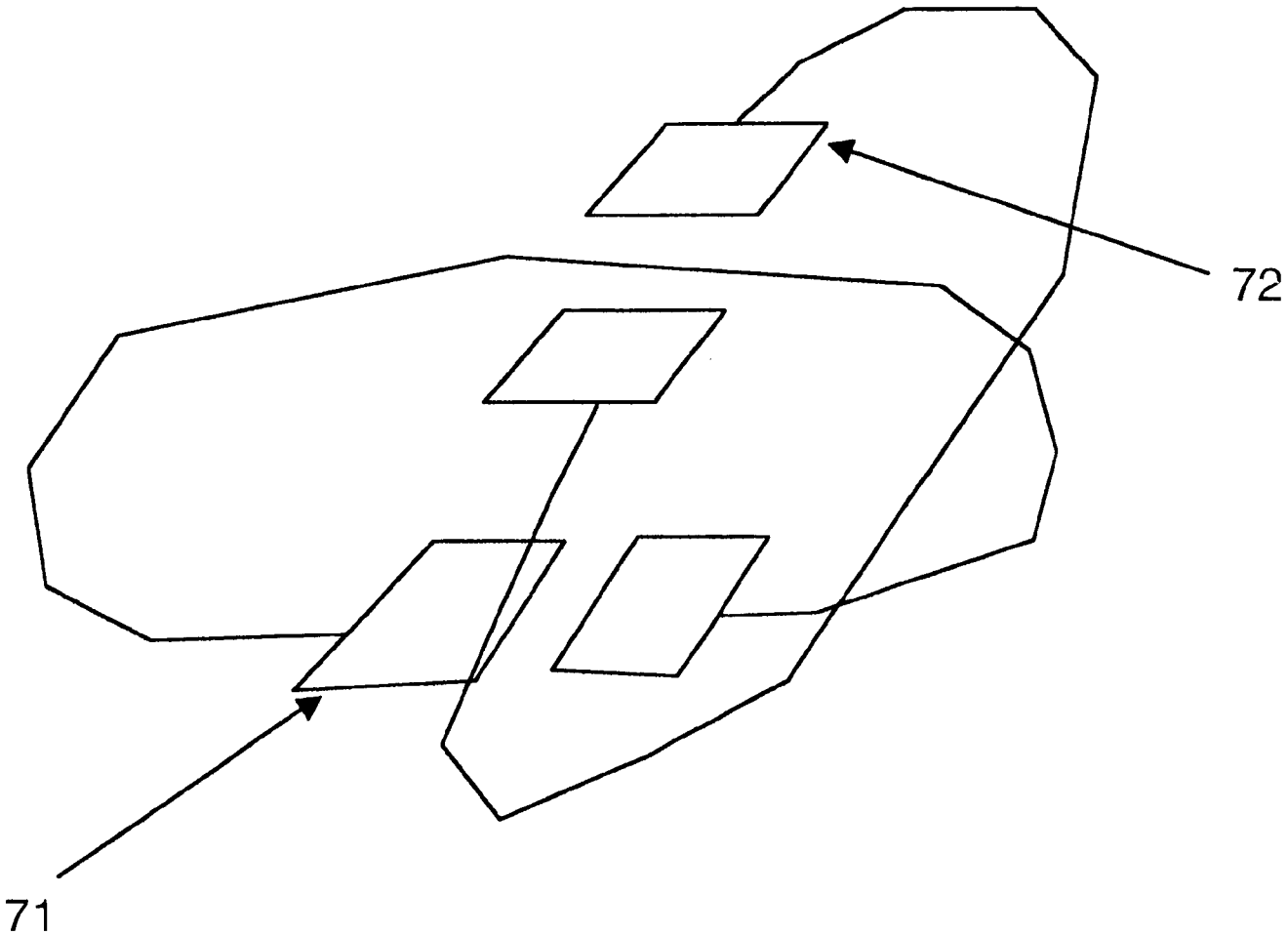
-Fig. 11-

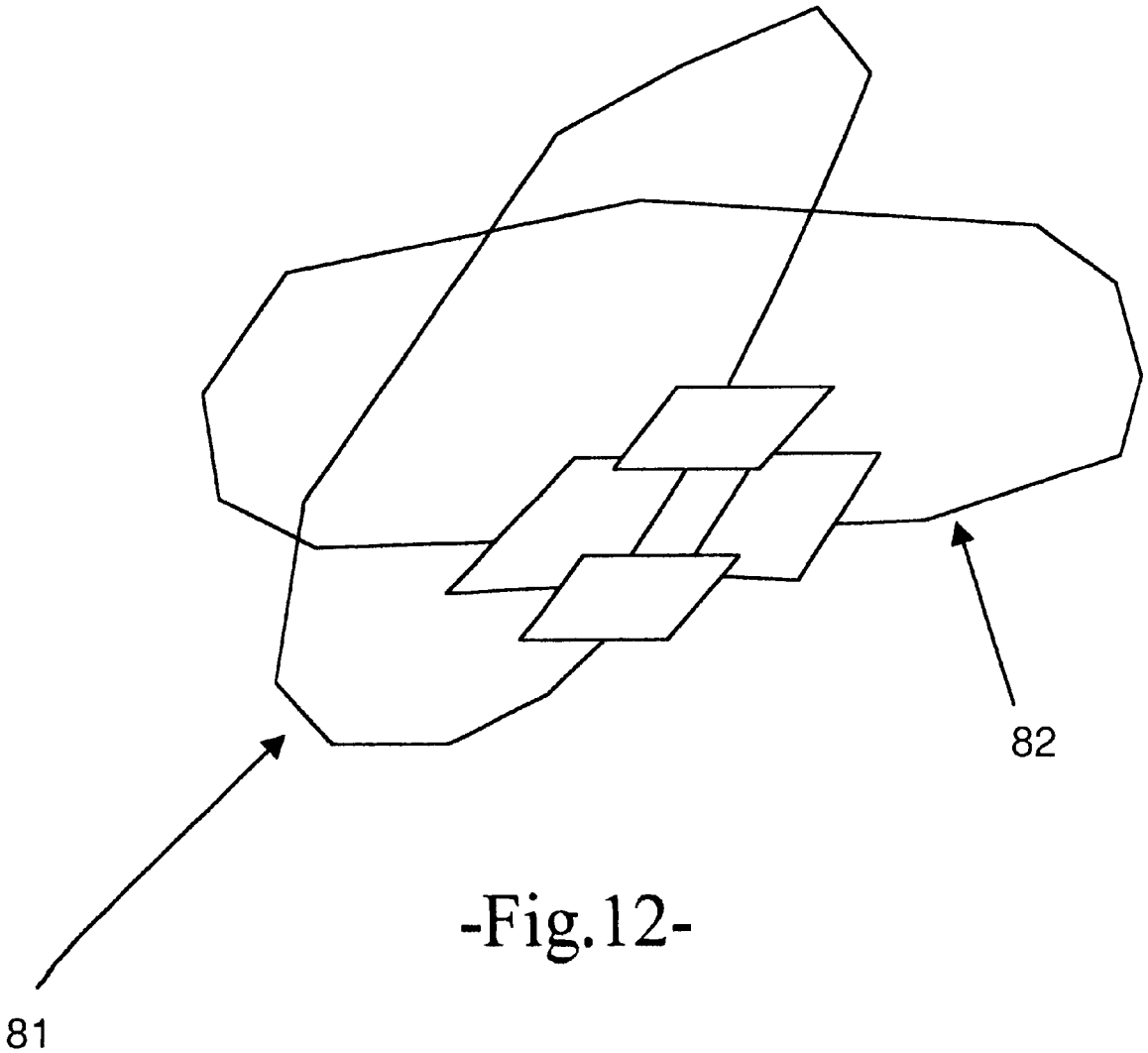
-Fig.12-

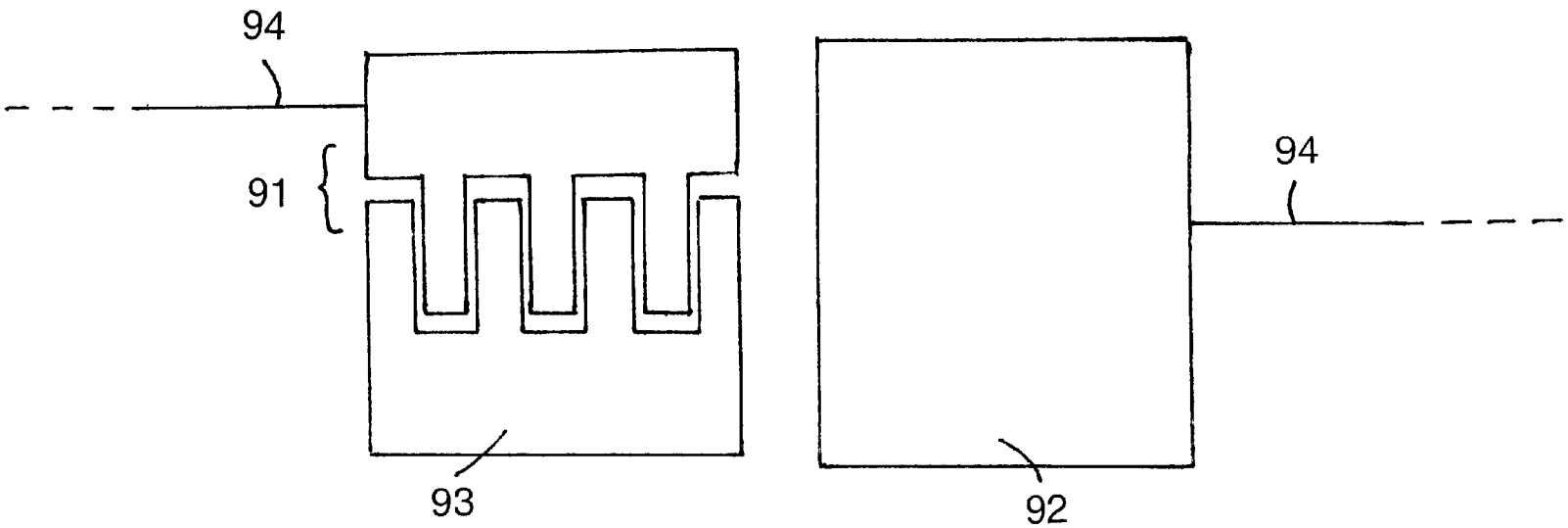
-Fig. 13-

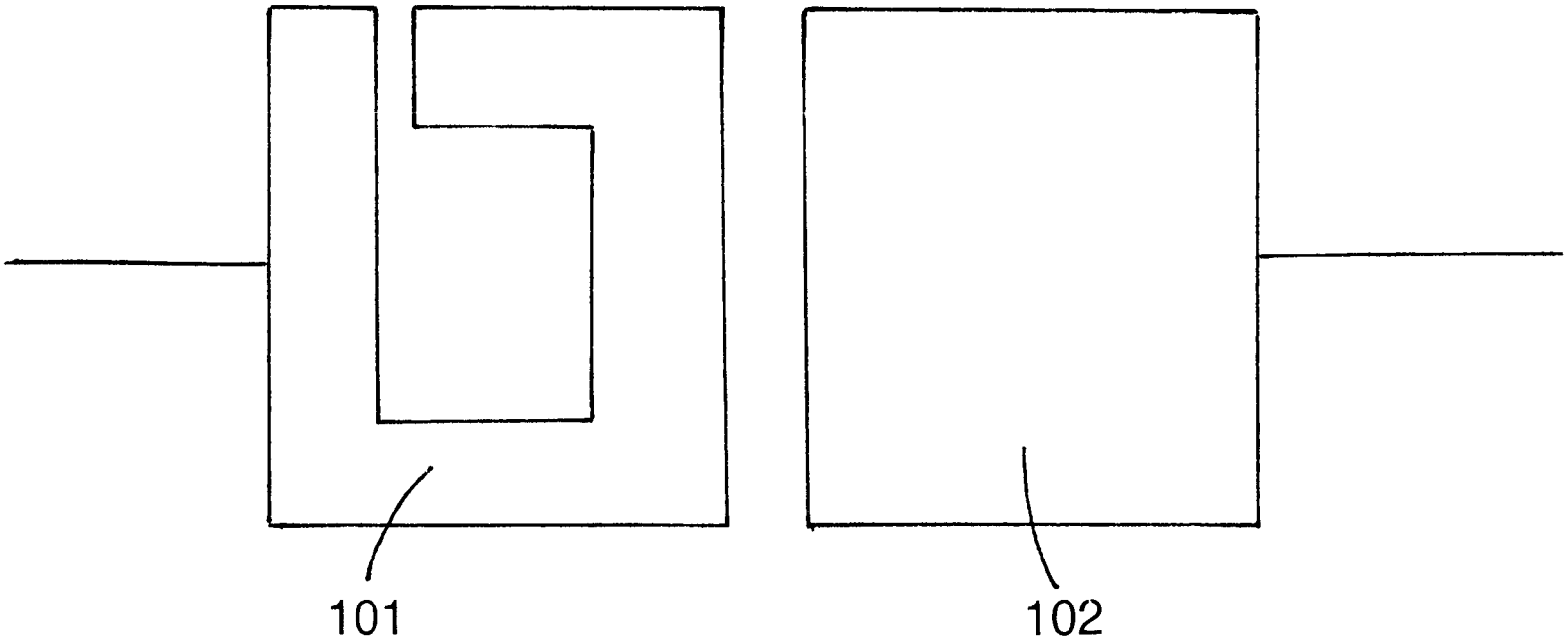
-Fig. 14-

INTEGRATED MULTIFREQUENCY SLOT/ PATCH ANTENNA AND METHOD

RELATED APPLICATIONS

This application relates to co-pending U.S. patent application Ser. No. 09/781,770, entitled "Spiral Sheet Antenna Structure and Method" by Eli Yablonovitch, et al., owned by the assignee of this application and incorporated herein by reference.

BACKGROUND OF THE INVENTION

1. Field of the Invention

The present invention relates generally to the field of wireless communications, and particularly to the design of an antenna.

2. Background

Small antennas are required for portable wireless communications. To produce a resonant antenna structure at a certain radio frequency and within a certain bandwidth, classical antenna structures need to have a certain volume. This volume becomes fairly large as the bandwidth required is large.

H. A. Wheeler, "Small Antennas" IEEE trans. on Antennas and Propagation, Vol. AP-Jul. 23, 1975, provides a formula linking the volume of an antenna and the frequency. It is necessary to have a certain volume in order to obtain a desired bandwidth. In the case of a small portable device, a solution for maximizing the antenna volume, and hence the antenna bandwidth, is to wrap the antenna around the device.

Accordingly, the present invention addresses the need for a small compact antenna with wide bandwidth that can be integrated with a mobile device.

SUMMARY OF THE INVENTION

The present invention provides an antenna structure with the approximate characteristics of a slotted cylinder. Rather than utilizing a complete cylinder, the antenna structure utilizes a pair of spaced-apart patches that are joined together by one or more transmission lines that loop around with the same length as the perimeter of a corresponding cylinder. The antenna structure may be advantageously "wrapped" around an enclosure for an electronic device, such as a cellular telephone or the like.

In one form, the present invention provides an antenna comprising first and second conductive patches having respective first edges separated by a gap and having second respective edges; at least one conductor joining the respective second edges of the two patches, the conductor being routed in a loop away from the patches in a direction perpendicular thereto; and an antenna feed coupled to at least one of the patches.

BRIEF DESCRIPTION OF THE DRAWINGS

FIG. 1 illustrates a radiating element in the form of a slotted rectangular cylinder.

FIG. 2 illustrates a radiating element in the form of a slotted circular or oval cylinder.

FIG. 3 is a perspective view of a radiating structure in accordance with the present invention.

FIG. 4 illustrates a feed arrangement for the structure of FIG. 3.

FIG. 5 is a perspective view of an alternative feed arrangement.

FIG. 6 illustrates an electronic device utilizing an antenna in accordance with the present invention.

FIG. 7 illustrates routing of a transmission line in order to avoid an obstruction.

FIG. 8 is a perspective view of a radiating structure with filters in the transmission lines.

FIG. 9 illustrates a slotted radiating patch.

FIG. 10 illustrates an antenna structure utilizing a plurality of electromagnetically coupled elements.

FIG. 11 illustrates a multiple element antenna structure with improved bandwidth and polarization diversity.

FIG. 12 illustrates another multiple element antenna structure with improved bandwidth and polarization diversity.

FIG. 13 illustrates one form of a doubly resonant antenna element.

FIG. 14 illustrates another form of a doubly resonant antenna element.

DETAILED DESCRIPTION OF THE INVENTION

In the following description, for purposes of explanation and not limitation, specific details are set forth in order to provide a thorough understanding of the present invention. However, it will be apparent to one skilled in the art that the present invention may be practiced in other embodiments that depart from these specific details. In other instances, detailed descriptions of well-known methods and devices are omitted so as to not obscure the description of the present invention with unnecessary detail.

FIG. 1 illustrates a radiating structure 10 in the form of a slotted rectangular cylinder. Energy is radiated principally from the open ends of the cylinder as a result of the electrical charges that accumulate at the ends as described in patent application Ser. No. 09/781,779. The mechanism by which energy is radiated from structure 10 is also explained in detail in the Wheeler reference. The frequency of the radiated energy is a function of the width of gap g, which also defines the capacitance of the structure.

With reference to FIG. 2, slotted cylindrical radiating structure 12 may be characterized as an inductor with a magnetic field B propagating from the center of the cylinder, parallel to the slot. The perimeter surface 14 of the cylinder may be analyzed as a transmission line that controls the phase shift appearing across the gap g. In this context, it can be seen that it is not necessary to consider the entire surface of cylinder 12 in order to characterize the radiating properties of the cylinder.

FIG. 3 illustrates a modification of the slotted cylinder shown in FIG. 2 wherein substantial portions of the cylindrical surface have been removed. Radiating structure 20 comprises spaced-apart strips or patches 21 and 22 which are connected by a plurality of transmission lines 24. Provided that the lengths of transmission lines 24 correspond to the perimeter 14 of cylinder 12 (FIG. 2), structure 20 and cylinder 12 will have essentially similar radiating characteristics.

A feed arrangement for radiating structure 20 is illustrated in FIG. 4. The center conductor 27 of a coaxial feed 26 is coupled to patch 22. The ground 28 is coupled to one of the transmission lines 24.

Other feed arrangements may also be used. For example, FIG. 5 illustrates a feed arrangement utilizing a co-planar wave guide 30.

One of the principal advantages of radiating structure 20 is the ability to "wrap" an antenna around an electronic device 40, such as a cellular telephone as shown in FIG. 6. The antenna may be wrapped around the surface of the device or may be molded into the plastic casing of the device.

FIG. 7 illustrates another advantage of the present invention. Because the radiating patches 21 and 22 are connected by discrete transmission lines 24, these lines may be conveniently routed around any obstructions, such as component 42. As long as the lines all have equal lengths, the characteristics of the antenna will not be significantly affected.

Referring now to FIG. 8, the characteristics of antenna 20 can be adjusted by inserting filters 50 in some or all of transmission lines 24. In particular, the lengths of lines 24 and the characteristics of filters 50, either band stop or band pass, may be set so that the transmission line lengths are different for different frequencies, thereby providing a multifrequency antenna. This approach has particular application to future triple-band mobile phone systems.

With reference to FIG. 9, one or both of patches 21 and 22 may include slots 54. Such slots alter the characteristic impedance of the antenna and may be used as another approach to achieving a multi-frequency antenna.

FIG. 10 illustrates another embodiment of the present antenna. Antenna structure 60 utilizes a plurality of elements comprising pairs of radiating patches 61, 62. The individual patches of each such pair are connected by a transmission line 64 as in the previously described embodiments. In this case, only one of the elements may be excited by a direct feed, the other elements being excited through electromagnetic coupling. The various elements of the antenna may be tuned to slightly different frequencies so that the overall bandwidth of the antenna is greatly improved.

Variations of the basic radiating structure of the present invention can be used to achieve wide bandwidth and/or diversity. One example is illustrated in FIG. 11 where two radiating elements 71, 72 are arranged at right angles to provide polarization diversity.

A similar structure is illustrated in FIG. 12. In this case, elements 81 and 82 are arranged with the radiating patches on the same side of the antenna volume. In this arrangement cross-polarization is reduced.

FIG. 13 illustrates an antenna element comprising patches 91 and 92 connected by a transmission line 94. This structure is doubly resonant at frequencies $f_1$ and $f_2$. At frequency $f_1$, only half of the capacitance across gap g is seen. Portion 93 of patch 91 is decoupled. At frequency $f_2$, patch 91 appears as if it were a solid conductor and the capacitance between patches 91 and 92 is at a maximum.

FIG. 14 illustrates another multi-frequency configuration. Here, patch 101 has two different current repartitions at different frequencies $f_1$ and $f_2$. The capacitance between patches 101 and 102 is therefore different at frequencies $f_1$ and $f_2$.

In all of the previously described embodiments, the capacitance of the antenna element(s) may be increased by overlapping the two patches of the element. This allows the overall dimensions of the antenna to be reduced, although with a consequent reduction in the bandwidth of the antenna.

It will be recognized that the above-described invention may be embodied in other specific forms without departing from the spirit or essential characteristics of the disclosure. Thus, it is understood that the invention is not to be limited by the foregoing illustrative details, but rather is to be defined by the appended claims.

What is claimed is:

1. An antenna comprising:

first and second conductive patches having respective first edges separated by a gap and respective second edges;

at least one conductor joining the respective second edges of the first and second patches, the conductor being routed in a loop away from the patches in a direction perpendicular thereto; and an antenna feed coupled to at least one of the patches;

wherein the conductor is one of a plurality of spaced apart conductors, each joining the respective second edges of the first and second patches.

2. The antenna of claim 1 wherein at least one of the patches is slotted.

3. The antenna of claim 1 wherein at least one of the patches comprises two spaced-apart segments.

4. The antenna of claim 3 wherein the conductor is connected to only one of the two spaced-apart segments.

5. The antenna of claim 3 wherein the two segments are spaced apart by a serpentine gap.

6. The antenna of claim 1 wherein the antenna feed comprises a signal feed coupled to at least one of the patches and a ground coupled to the conductor.

7. An antenna comprising:

first and second conductive patches having respective first edges separated by a gap and respective second edges;

at least one conductor joining the respective second edges of the first and second patches, the conductor being routed in a loop away from the patches in a direction perpendicular thereto; and an antenna feed coupled to at least one of the patches;

wherein the first and second conductive patches comprise one of a plurality of pairs of conductive patches, each pair having respective first edges separated by a gap and at least one conductor joining respective second edges of the pair of patches, said at least one conductor being routed in a loop away from the pair of patches in a direction perpendicular thereto; and wherein at least one of the pairs of patches is oriented orthogonally to another of the pairs of patches.

8. The antenna of claim 7 wherein at least one of the patches is slotted.

9. The antenna of claim 7 wherein at least one of the patches comprises two spaced-apart segments.

10. The antenna of claim 9 wherein the conductor is connected to only one of the two spaced-apart segments.

11. The antenna of claim 9 wherein the two segments are spaced apart by a serpentine gap.

12. The antenna of claim 7 wherein the antenna feed comprises a signal feed coupled to at least one of the patches and a ground coupled to the conductor.

13. An antenna comprising:

first and second conductive patches having respective first edges separated by a gap and respective second edges;

at least one conductor joining the respective second edges of the first and second patches, the conductor being routed in a loop away from the patches in a direction perpendicular thereto;

an antenna feed coupled to at least one of the patches; and a filter having first and second ports, the conductor joining the second edge of the first patch to the first port of the filter and joining the second edge of the second patch to the second port of the filter.

14. An electronic device comprising:

electronic circuitry for receiving or transmitting an electromagnetic signal;

a housing enclosing the electronic circuitry;

an antenna electrically coupled to the electronic circuitry, the antenna comprising first and second conductive patches disposed proximate to a first surface of the housing having respective first edges separated by a gap and respective second edges, the antenna further comprising at least one conductor joining the respective second edges of the first and second patches, the conductor routed proximate to a second surface of the housing opposite the first surface and spaced apart therefrom; and wherein the conductor is one of a plurality of spaced apart conductors, each joining the respective second edges of the first and second patches and routed proximate to the second surface.

15. The electronic device of claim 14 wherein at least one of the patches is slotted.

16. The electronic device of claim 14 wherein at least one of the patches comprises two spaced-apart segments.

17. The electronic device of claim 16 wherein the conductor is connected to only one of the two-spaced apart segments.

18. The electronic device of claim 16 wherein the two segments are spaced apart by a serpentine gap.

19. The electronic device of claim 14 further comprising an antenna feed coupled to at least one of the patches.

20. The electronic device of claim 19 wherein the antenna feed comprises a signal feed coupled to at least one of the patches and a ground coupled to the conductor.

21. An electronic device comprising:

electronic circuitry for receiving or transmitting an electromagnetic signal;

a housing enclosing the electronic circuitry;

an antenna electrically coupled to the electronic circuitry, the antenna comprising first and second conductive patches disposed proximate to a first surface of the housing having respective first edges separated by a gap and respective second edges, the antenna further comprising at least one conductor joining the respective second edges of the first and second patches, the conductor routed proximate to a second surface of the housing opposite the first surface and spaced apart therefrom;

wherein the first and second conductive patches comprise one of a plurality of pairs of conductive patches, each pair disposed proximate to the first surface and having respective first edges separated by a gap and at least one conductor routed proximate to the second surface joining respective second edges of the pair of patches; and wherein at least one of the pairs of patches is oriented orthogonally to another of the pairs of patches.

22. The electronic device of claim 21 wherein at least one of the patches is slotted.

23. The electronic device of claim 21 wherein at least one of the patches comprises two spaced-apart segments.

24. The electronic device of claim 23 wherein the conductor is connected to only one of the two-spaced apart segments.

25. The electronic device of claim 23 wherein the two segments are spaced apart by a serpentine gap.

26. The electronic device of claim 21 further comprising an antenna feed coupled to at least one of the patches.

27. The electronic device of claim 26 wherein the antenna feed comprises a signal feed coupled to at least one of the patches and a ground coupled to the conductor.

28. An electronic device comprising:

electronic circuitry for receiving or transmitting an electromagnetic signal;

a housing enclosing the electronic circuitry;

an antenna electrically coupled to the electronic circuitry, the antenna comprising first and second conductive patches disposed proximate to a first surface of the housing having respective first edges separated by a gap and respective second edges, the antenna further comprising at least one conductor joining the respective second edges of the first and second patches, the conductor routed proximate to a second surface of the housing opposite the first surface and spaced apart therefrom; and a filter having first and second ports, the conductor joining the second edge of the first patch to the first port of the filter and joining the second edge of the second patch to the second port of the filter.

29. An antenna comprising:

first and second conductive patches having respective first edges separated by a gap and respective second edges, at least one of the patches comprising two spaced-apart segments;

at least one conductor joining the respective second edges of the first and second patches, the conductor being connected to only one of the two spaced-apart segments and the conductor being routed in a loop away from the patches in a direction perpendicular thereto; and an antenna feed coupled to at least one of the patches.

30. The antenna of claim 29 wherein the two segments are spaced apart by a serpentine gap.

31. An electronic device comprising:

electronic circuitry for receiving or transmitting an electromagnetic signal;

a housing enclosing the circuitry; and an antenna electrically coupled to the electronic circuitry, the antenna comprising first and second conductive patches disposed proximate to a first surface of the housing having respective first edges, at least one of the patches comprising two spaced-apart segments, the antenna further comprising at least one conductor joining the respective second edges of the first and second patches, the conductor being connected to only one of the two spaced-apart segments and the conductor being routed proximate to a second surface of the housing opposite the first surface and spaced apart therefrom.

32. The electronic device of claim 31 wherein the two segments are spaced apart by a serpentine gap.

33. The electronic device of claim 31 further comprising an antenna feed coupled to at least one of the patches.

34. The electronic device of claim 33 wherein the antenna feed comprises a signal feed coupled to at least one of the patches and a ground coupled to the conductor.

* * * * *